United States Patent [19]

Martel et al.

[11] 4,024,613

[45] May 24, 1977

[54] METHOD OF PERMANENTLY ATTACHING METALLIC SPACERS IN GASEOUS DISCHARGE DISPLAY PANELS

[75] Inventors: Richard A. Martel, Toledo; Charles W. Salisbury, Risingsun, both of Ohio

[73] Assignee: Owens-Illinois, Inc., Toledo, Ohio

[22] Filed: Jan. 2, 1975

[21] Appl. No.: 537,947

[52] U.S. Cl. ..... 29/25.13; 228/110; 228/111; 313/220

[51] Int. Cl.[2] ..... H01J 61/30

[58] Field of Search ..... 228/110, 111; 29/25.13; 316/17–21; 313/220

[56] References Cited

UNITED STATES PATENTS

| | | | |
|---|---|---|---|
| 3,330,026 | 7/1967 | Best et al. | 228/111 |
| 3,499,167 | 3/1970 | Baker et al. | 313/220 X |
| 3,837,724 | 9/1974 | Haberland | 313/220 X |
| 3,860,424 | 1/1975 | Johnson | 29/25.13 |
| 3,869,630 | 3/1975 | Maio | 313/220 X |

*Primary Examiner*—Al Lawrence Smith
*Assistant Examiner*—K. J. Ramsey
*Attorney, Agent, or Firm*—Donald Keith Wedding

[57] ABSTRACT

There is disclosed a method of permanently attaching metallic spacers in gaseous discharge display panels by ultrasonically bonding said spacers between the glass substrates thereof to thin film metal tabs located between the electrodes. Such a method prevents any subsequent movement of the spacers after attachment and makes the spacers substantially invisible to the naked eye. The article so bonded is also an integral part of this invention.

8 Claims, 2 Drawing Figures

Figure 1:
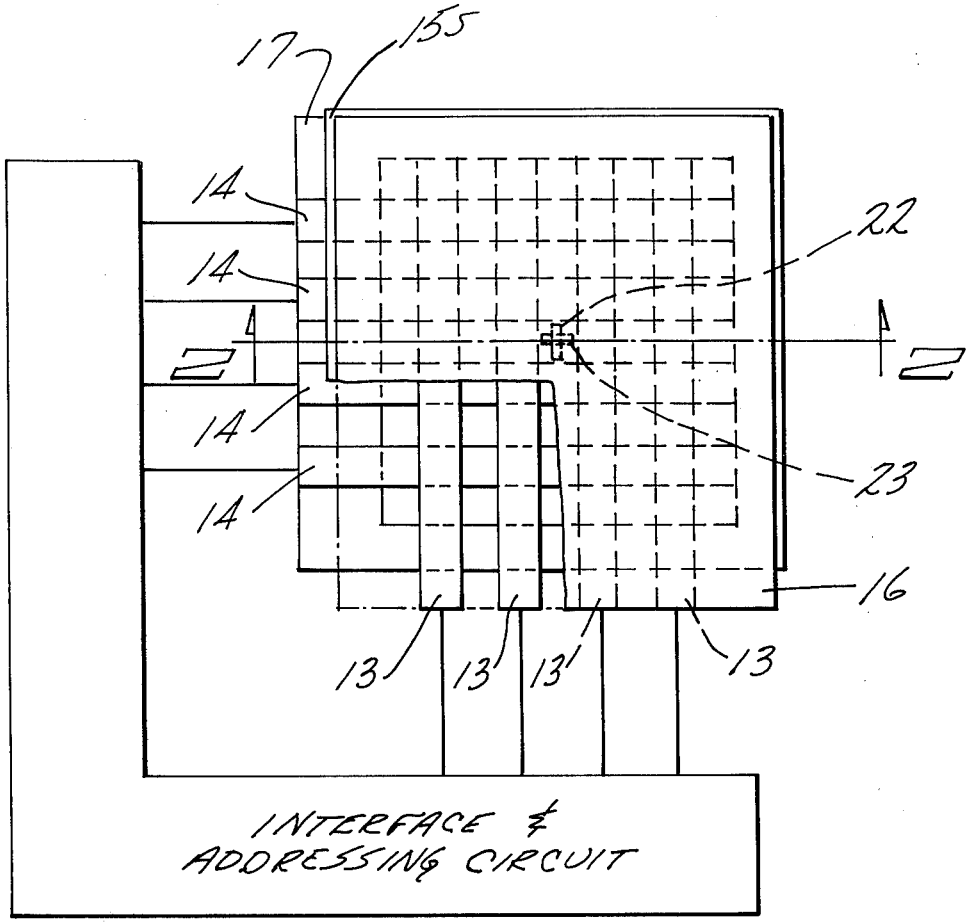

METHOD OF PERMANENTLY ATTACHING METALLIC SPACERS IN GASEOUS DISCHARGE DISPLAY PANELS

BACKGROUND OF THE INVENTION

This invention relates to the manufacture of gas discharge devices, especially A.C. (alternating current) multiple gas discharge display/memory devices which have an electrical memory and which are capable of producing a visual display or representation of data such as numerals, letters, radar displays, aircraft displays, binary words, educational displays, etc.

Multiple gas discharge display and/or memory panels of one particular type with which the present invention is concerne are characterized by an ionizable gaseous medium, usually a mixture of at least two gases at an appropriate gas pressure, in a thin gas chamber or space between a pair of opposed dielectric charge storage members which are backed by conductor (electrode) members, the conductor members backing each dielectric member typically being appropriately oriented so as to define a plurality of discrete gas discharge units or cells.

In some prior art panels the discharge cells are additionally defined by surrounding or confining physical structure such as apertures in perforated glass plates and the like so as to be physically isolated relative to other cells. In either case, with or without the confining physical structure, charges (electrons, ions) produced upon ionization of the elemental gas volume of a selected discharge cell, when proper alternating operating potentials are applied to selected conductors thereof, are collected upon the surfaces of the dielectric at specifically defined locations and constitute an electrical field opposing the electrical field which created them so as to terminate the discharge for the remainder of the half cycle and aid in the initiation of a discharge on a succeeding opposite half cycle of applied voltage, such charges as are stored constituting an electrical memory.

Thus, the dielectric layers prevent the passage of substantial conductive current from the conductor members to the gaseous medium and also serve as collecting surfaces for ionized gaseous medium charges (electrons, ions) during the alternate half cycles of the A.C. operating potentials, such charges collecting first on one elemental or discrete dielectric surface area and then on an opposing elemental or discrete dielectric surface area on alternate half cycles to constitute an electrical memory.

An example of a panel structure containing non-physically isolated or open discharge cells is disclosed in U.S. Pat. No. 3,499,167 (incorporated herein by reference) issued to Theodore C. Baker, et al.

An example of a panel containing physically isolated cells is disclosed in the article by D. L. Bitzer and H. G. Slottow entitled "The Plasma Display Panel— A Digitally Addressable Display With Inherent Memory", Proceeding of the Fall Joint Computer Conference, IEEE, San Francisco, California, Nov. 1966, pages 541–547 and also in U.S. Pat. No. 3,559,190 (incorporated herein by reference).

In the construction of the panel, a continuous volume of ionizable gas is confined between a pair of dielectric surfaces backed by conductor arrays typically forming matrix elements. The two conductor arrays may be orthogonally related sets of parallel lines (but any other configuration of conductor arrays may be used). The two arrays define at their intersections a plurality of opposed pairs of charge storage areas on the surfaces of the dielectric bounding or confining the gas. Thus, for a conductor matrix having H rows and C columns the number of elemental or discrete areas will be twice the number of elemental discharge cells.

In addition, the panel may comprise a so-called monolithic structure in which the conductor arrays are created on a single substrate and wherein two or more arrays are separated from each other and from the gaseous medium by at least one insulating member. In such a device the gas discharge takes place not between two opposing elemental areas on two different substrates, but between two contiguous or adjacent elemental areas on the same substrate; the gas being confined between the substrate and an outer retaining wall.

It is also feasible to have a gas discharge device wherein some of the conductive or electrode members are in direct contact with the gaseous medium and the remaining electrode members are appropriately insulated from such gas, i.e., at least one insulated electrode.

In the prior art there exists D.C. (direct current) devices where the electrodes consist of an anode and a cathode which are typically in direct contact with the ionizable gaseous medium. It is also possible to construct such D.C. devices utilizing a dielectric overcoat, i.e., the same structure and configuration as an A.C. gas discharge display/memory panel described hereinbefore.

A wide variety of such devices exist in the prior art. Examples of such devices are disclosed in U.S. Pat. Nos. 2,142,106; 3,260,880; 3,720,452; 3,725,713; 3,237,040, and 3,497,751, all of which are incorporated herein by reference.

The present invention is intended to relate to the manufacture of all types of A.C. and D.C. display panels.

In addition to the matrix configuration, the conductor arrays of the display device (D.C. or A.C.) may be shaped otherwise. Accordingly, while the preferred conductor arrangement is of the crossed grid type as discussed herein, it is likewise apparent that where a maximal variety of two dimensional display patterns is not necessary, as where specific standardized visual shapes (e.g., numerals, letters, words, etc.) are to be formed and image resolution is not critical, the conductors may be shaped accordingly (e.g., a segmented digit display).

The gas is selected to produce visible light and invisible radiation which may be used to stimulate a phosphor (if visual display is an objective) and a copious supply of charges (ions and electrons) during discharge.

In the prior art, a wide variety of gases and gas mixtures have been utilized as the gaseous medium in a number of different gas discharge devices. Typical of such gases include pure gases and mixture of CO; $CO_2$; halogens; nitrogen; $NH_3$; oxygen; water vapor; hydrogen; hydrocarbons; $P_2O_5$; boron fluoride; acid fumes; $TiCl_4$; air;$H_2O_2$; vapors of sodium, mercury, thallium, cadmium, rubidium, and cesium; carbon disulfide; $H_2S$; deoxygenated air; phosphorus vapors; $C_2H_2$; $CH_4$; naphthalene vapor; anthracene; freon; ethyl alcohol; methylene bromide; heavy hydrogen; electron attaching gases; sulfur hexafluoride; tritium; radioactive gases; and the so-called rare or inert Group VIII gases.

To obtain uniform resolution over the entire display surface of a gas discharge panel, it is imperative that the space between opposing walls of the gas envelope be uniform and that the walls of the chamber be sealed to provide a gas filled container.

Several methods of sealing such panels with various spacers therebetween appear in the prior art. For example, epoxy has been used as a sealant but produces impurities in the gas mixture which decreases the life of the panel. In situ fabrication of gas panels with solder glass as a sealant has also been utilized but uniform deposition of the sealant is difficult. In order to resolve these problems a soft glass rod sealant and a hard glass rod spacer has been used as described in U.S. Pat. No. 3,778,127 wherein the upper plate of the gas panel settles upon the spacing rods during a bakeout operation thus establishing a predetermined and uniform spacing within the envelope. However, such glass spacers tend to crack and shift position after attachment.

Another glass sealing composition especially suitable for sealing together the two glass substrates of a multiple gas discharge display panel so as to provide a hermetically sealed ionizable gas chamber is disclosed in U.S. Pat No. 3,734,702 comprising a lead borosilicate solder glass containing 18% by weight of aluminum titanate which inhibits crystallization thus developing a seal with even stress concentration.

Despite the advances which have been made in placing spacers at discrete locations within such panels to prevent the two glass substrates from flexing inwardly due to the reduced gas pressure within the gas chamber, the problem of preventing movement of such spacers during assembly of the panel still persists. Furthermore, the glass and metal spacers used in the past cause both electrical and optical interference depending upon the choice of materials and the process used for the placement and attachment of such spacers.

SUMMARY OF THE INVENTION

This invention relates to the use of ultrasonic bonding techniques to affix the metallic spacer material to a thin film metal tab located between the electrode lines of a gaseous discharge display panel thus preventing any shift in position of such spacers during assembly or in the finished panel. The features and advantages of the invention will be better understood by reference to the following detailed description when considered in connection with the accompanying drawings.

Figure 2:
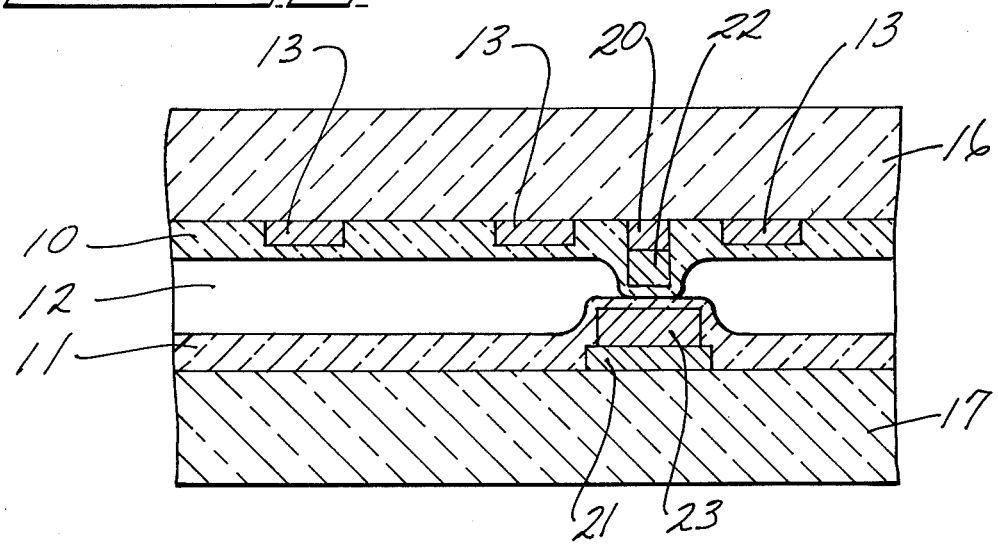

FIG. 1 is a partially cut-away plan view of a gaseous discharge display/memory panel as connected to a diagrammatically illustrated source of operating potentials; and FIG. 2 is a cross-sectional view (enlarged, but not to proportional scale since the thickness of the gas volume, dielectric members, conductor arrays, etc. have been enlarged for purposes of illustration) taken on the lines 2—2 of FIG. 1.

PREFERRED EMBODIMENTS OF THE INVENTION

A gaseous discharge display/memory panel incorporating the invention utilizes a pair of dielectric coatings or members 10 and 11 separated by a thin layer or volume of a gaseous discharge medium 12. Conductor matrixes 13 and 14 are located on the side of the dielectric members 10 and 11 respectively opposite the gaseous discharge medium 12, while the electrically operative structural members, namely, the dielectric members 10 and 11 and conductor matrixes 13 and 14 are all relatively thin (being exaggerated in thickness in the drawings), are formed on and supported by rigid, non-conductive support members 16 and 17 respectively.

Preferably, one or both of the non-conductive support members 16 and 17 pass light produced by discharge in the elemental gas volume. The support members 16 and 17 may be transparent glass members which essentially define the overall thickness and strength of the panel. For example, the thickness of gas layer 12 is under 10 mils and preferably about 5 to 6 mils, dielectric members 10 and 11 are between 1 and 2 mils thick, and conductors 13 and 14 about 8000 angstroms thick. However, support members 16 and 17 are much thicker (particularly larger panels) so as to provide as much ruggedness as may be desired to compensate for stresses in the panel.

The panel is hermetically sealed about the perimeter with a high-strength devitrified glass sealant 15S to form the chamber containing the gaseous discharge medium 12

In accordance with the present invention, thin film metal tabs 20 and 21 are formed between adjacent electrodes 13 and 14 in the center area of each of the support members 16 and 17. Metal spacers 22 and 23 are then affixed to the tabs 20 and 21 respectively by ultrasonic bonding. The thin dielectric coatings or members 10 and 11 are then applied over the entire surface areas of the support members 16 and 17 including the conductors 13 and 14 and metal spacers 22 and 23.

Ultrasonic bonding is a cold bonding technique in which no external heat is applied. The method is adaptable to the joining of dissimilar materials as well as sections having different thicknesses. The bond is produced by pressing a lead wire against the surface to which it is to be joined. The pressure is applied by the tip of a transducer that is vibrating at about 60 kilocycles per second. The mechanical force and scrubbing action cause molecular mingling of the two surfaces in contact and thereby form a bond. By such a technique, it is possible to bond aluminum wire and ribbon to a wide range of materials including glass although ultrasonic welding is best suited to ductile metals such as aluminum, gold, silver and copper.

The thin film metal tabs 20, 21 used in this invention are approximately 1000 Angstroms thick and 1/16 to ¼ inch in length whereas the metal spacers 22, 23 are from 3 to 7 mils thick and 8 to 10 mils in diameter. The tabs and spacers can be composed of the same metal — for example aluminum or the metal can be dissimilar — i.e., chromium can be first evaporated on the glass substrate and then over-layered with aluminum or other metals such as copper, gold or silver. It is especially advantageous to have the thin film metallic tabs incorporated in the original network of the electrode pattern spaced at intervals of ½ to 2 inches apart between the electrodes. The metal spacers either in the form of discs or rods (preferably 10 mils in diameter) are then attached to these tabs by ultrasonic bonding. A sufficient number of such tabs are provided with attached spacers to both substrates to insure uniform gap spacing in a finished panel and the thin or thick film dielectric material is subsequently applied by sputtering before the entire assembly is sealed at about 450° C. to fuse the component parts into a single integral unit.

The following examples set forth in more detail the best mode now contemplated for practicing the present invention.

EXAMPLE 1

A gaseous discharge display panel was assembled by the sequence of steps herein described:

1. aluminum tabs about 1000 Angstroms thick and 1/16 inch long were vacuum deposited at 2 inches intervals between the aluminum conductor arrays spaced at 60 lines per inch on two glass plates made of conventional soda-lime-silicate glass ¼ inch thick. One of the plates served as the lower substrate of the display panel whereas the other plate served as the upper substrate. The tabs and conductors were deposited simultaneously on the two plates with the tabs positioned in the center of each plate in such a pattern that when the upper and lower plates were turned 90° with respect to each other as they will be when assembled into a display panel, the upper and lower plate tabs were aligned in overlying relationship with one another. 2. aluminum spacers 3 mils thick and 8 mils in diameter were ultrasonically bonded to the exposed aluminum tabs on each glass plate. 3. the bonded spacers, tabs and conductors were then coated with a dielectric layer of lead-borosilicate glass less than one mil thick and fired at 600° C.

4. sealing glass was applied to the outer edges of the lower plate before the upper plate with its exhaust outlet was clamped thereto with its conductors positioned 90° with respect to the conductors of the lower plate whereas the spacers on both plates were mated to each other to prevent electrical shorting. 5. the entire assembly was heated in an oven at 450° C. until the two substrates were completely sealed.

6. the confined space between the substrates was filled with nitrogen and the exhaust tube sealed.

The spacers of the completed panel were permanently attached without any further movement during assembly and were difficult to detect with the naked eye because of their size, geometry and reflective quality and no electrical shorts resulted.

EXAMPLE 2

On the surface of a soda-lime-silicate glass plate ¼ inch thick, there was deposited by evaporation gold conductor arrays at preselected intervals of about 60 lines per inch. Copper tabs about ¼ inch long and 1000 Angstroms thick were then evaporated on the glass plate at ½ inch intervals between the electrodes in the center area of each plate and copper spacers about 20 mils in diameter and 3 mils thick were ultrasonically bonded to said tabs.

The electrodes, tabs and spacers were silk screened with a 1 mil thick dielectric layer of lead-borosilicate glass and fired at 600° C.

This same procedure was repeated on a second glass plate. One plate with an exhaust outlet was placed over the other plate in orthogonal fashion so that the spacers of both plates were in alignment. Sealing glass was applied to the outer edges of the plates and the two plates were clamped and heated at 425° C. to fuse the component parts into a single integral unit. The gas chamber of the panel was finally filled with neon and the exhaust tube was sealed. This thick film dielectric display panel was satisfactory in all respects — i.e., the spacers were practically invisible and no further shifting of the spacers occurred.

Other embodiments of the invention include the vacuum deposition of chromium conductors on glass plates overlayered with aluminum or silver. Spacers of aluminum or silver are then ultrasonically bonded to the thin film of the same metal before the solder glass dielectric is applied as previously described. With automatic ultrasonic bonding equipment, the method of this invention is very economical and highly reliable in that the spacers are permanently affixed to the substrates and do not shift during assembly of the completed gaseous discharge display device.

What is claimed is:

1. A method of permanently attaching metallic spacers in a gaseous discharge display panel which comprises ultrasonically bonding said spacers to tabs of the same metal deposited on the glass substrate of said panel between the conductors thereof.

2. A method as in claim 1 in which the spacers, tabs and conductors are aluminum.

3. A method as in claim 1 in which the spacers and tabs are copper and the conductors are gold.

4. A method as in claim 1 in which the spacers and tabs are silver and the conductors are gold.

5. A method as in claim 1 in which the spacers and tabs are aluminum and the conductors are chromium overlayered with aluminum.

6. A method as in claim 1 in which the metal tabs about 1000 Angstroms thick and from 1/16 inch to ¼ inch long are vacuum deposited at from ½ inch to 2 inches intervals on a glass substrate between the conductors spaced at 60 lines per inch.

7. A method as in claim 1 in which metal spacers about 3 to 7 mils thick and 8 to 20 mils in diameter are ultrasonically bonded to the metal tabs and the bonded spacers, tabs and conductors coated with a dielectric layer of lead-borosilicate glass less than one mil thick and fired at 600° C.

8. A method as in claim 7 in which the dielectric layer is at least one mil thick.

* * * * *